United States Patent [19]

Brenik et al.

[11] 4,343,318

[45] Aug. 10, 1982

[54] METHOD OF ENDOTHERMIC FERMENTATION OF TOBACCO

[75] Inventors: Wenzel Brenik, Grünwald; Heinz Rudhard, Geretsried, both of Fed. Rep. of Germany

[73] Assignee: Linde Aktiengesellschaft, Wiesbaden, Fed. Rep. of Germany

[21] Appl. No.: 165,805

[22] Filed: Jul. 3, 1980

[30] Foreign Application Priority Data

Jul. 5, 1979 [DE] Fed. Rep. of Germany ..... 2927188

[51] Int. Cl.[3] ..... A24B 3/18; A24B 15/18; A24B 15/20; A24B 15/28

[52] U.S. Cl. ..... 131/300; 131/302; 131/303; 131/308; 131/309

[58] Field of Search ..... 131/290, 300, 302, 303, 131/308, 309

[56] References Cited

U.S. PATENT DOCUMENTS

| | | | |
|---|---|---|---|
| 771,355 | 10/1904 | Daniels et al. | 131/309 |
| 1,518,706 | 12/1924 | Sartig | 131/309 |
| 1,757,477 | 5/1930 | Rosenhoch | 131/309 |
| 2,644,462 | 7/1953 | Frankenburg | 131/308 |
| 3,545,455 | 12/1970 | Egri | 131/308 |

FOREIGN PATENT DOCUMENTS

| | | | |
|---|---|---|---|
| 294537 | 12/1928 | United Kingdom | 131/309 |

*Primary Examiner*—V. Millin
*Attorney, Agent, or Firm*—Karl F. Ross

[57] ABSTRACT

A method of fermenting and aging tobacco under endothermic conditions in which the tobacco is fermented in an atmosphere containing more than 25% by volume oxygen and preferably in either pure oxygen or oxygen-enriched air. The tobacco product is thereby fermented more rapidly than with earlier endothermic techniques, with reduction in the nicotine content, less condensate, and reduced pesticide content.

4 Claims, 1 Drawing Figure

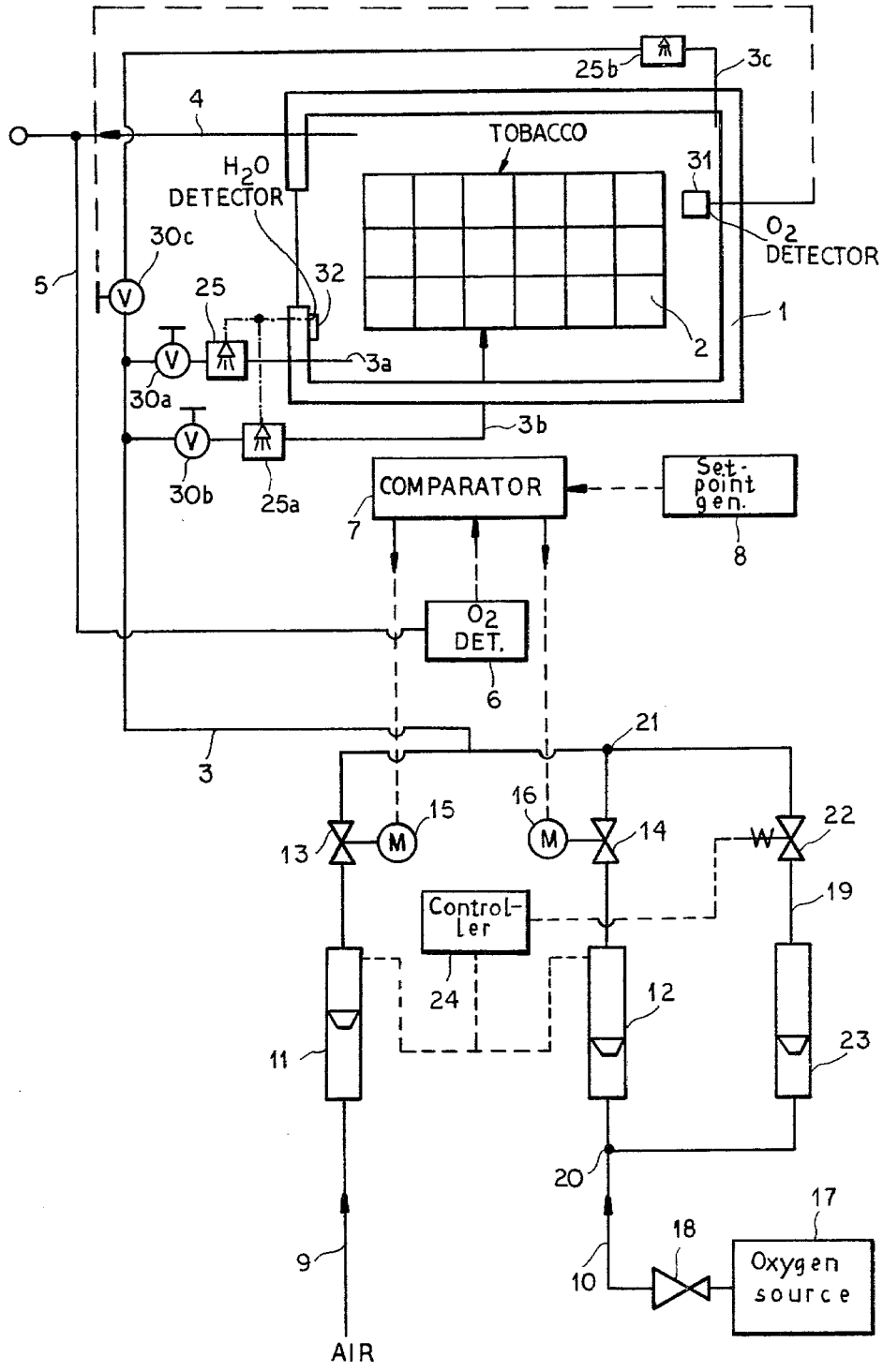
25b
3c
4
TOBACCO
31
$H_2O$
DETECTOR
$O_2$
DETECTOR
30c
5
25
32
1
2
3a
30a
3b
30b
25a
COMPARATOR
Set-point gen.
7
8
$O_2$
DET.
6
21
3
15
16
22
13
14
19
Controller
24
12
11
23
20
17
18
9
10
Oxygen source
AIR

METHOD OF ENDOTHERMIC FERMENTATION OF TOBACCO

FIELD OF THE INVENTION

Our present invention relates to a method of endothermic fermentation or curing of tobacco and, more particularly, to a more rapid fermentation process which yields an improved product.

BACKGROUND OF THE INVENTION

In the production of tobacco in finished product forms, especially smoking tobacco, the tobacco leaves, after harvesting, can be subjected to a fermentation or curing process which involves the degradation of organic structures within the leaf. These degradation processes begin during the drying of the tobacco and ultimately terminate.

The endothermic fermentation and curing processes which have been used heretofore, generally treat the tabacco in bales or in stacks or other accumulations of leaves on special carriages in closed chambers. The atmosphere in the chamber is ambient air and both the temperature and the moisture content of this atmosphere are controlled to regulate the fermentation process. In conventional endothermic fermentation or curing processes, as in the present case, the relative humidity in the chamber is generally held between 55% and 80% while the temperature is maintained between 30° C. and 60° C.

The endothermic fermentation process is significantly faster than natural fermentation although it too can require up to about six weeks.

Even after conventional fermentation processes, the tobacco contains relatively large proportions of nicotine and condensates.

OBJECTS OF THE INVENTION

The principal object of the present invention is to provide a process for improving the quality of tobacco and for fermenting and curing the same more rapidly.

SUMMARY OF THE INVENTION

These objects and others which will become more apparent hereinafter are attained, in accordance with the present invention, in which the tobacco is subjected to an endothermic fermentation in a controlled, oxygen-rich atmosphere containing more than 25% oxygen or oxygen-enriched air or some other gas having an oxygen content in excess of 25% by volume.

Surprisingly, we have found that this significantly reduces the fermentation duration and indeed the fermentation time is a function of the concentration of oxygen in the fermentation atmosphere, without any reduction in quality of the tabacco product and without any other detriment thereto.

By comparison with tobaccos which have been fermented in conventional atmospheres, e.g. ambient air, the tobacco product of the present invention manifests a reduced nicotine content and a reduced condensate content.

It has also been observed that the method of the present invention also reduces the residues in tobacco of pesticides which may have been applied at the crop site. More particularly, it has been found that the compositions which are applied to the tobacco crop to prevent failure and other plant diseases, to eliminate or reduce weeds at the plot site, and to prevent insect attack upon the plant, are decomposed or otherwise degraded during the fermentation according to the invention so that residues which are normally found on the tobacco are largely eliminated. As a result, herbicide residues are found on the tobacco product of the present invention to a lesser extent than on the product from the same field subjected to normal fermentation.

Similarly, rodenticides and compositions which are used to protect the plants or the harvested tobacco from attack by animal or other parasites are found to have reduced residue contents in the finished product.

The aforementioned advantages are all the more significant because the fermentation time is significantly reduced and one would normally expect that a shorter fermentation time would lead to less opportunity to decompose or eliminate such residues.

The shortened fermentation time is also advantageous because the tobacco product with the present invention has a greater aromaticity than tobacco which is fermented in ordinary ambient air.

After fermentation, the tobacco leaves can be stored in aerated, cooled clean compartments with predetermined moisture content and room temperature to maintain the moisture content of the tobacco relatively constant. Another surprising advantage of the present invention is that the shelf life or storage time for the tobacco product of the present invention can be markedly increased over conventionally fermented and cured tobaccos.

During fermentation a portion of the gases forming the fermentation atmosphere is consumed and the atmosphere receives gases evolved during the process. According to a feature of the invention, these wastes can be removed from the atmosphere or the atmosphere in the fermentation chamber can be discharged and replaced by pure oxygen or an oxygen-enriched gas containing more than 25% oxygen. Control of the process can be effected by monitoring the oxygen level in the discharged gases and controlling the feed of oxygen to the chamber in response thereto.

According to another feature of the invention, the oxygen-rich gas for forming or maintaining the atmosphere at its oxygen concentration of greater than 25%, is fed to the chamber at a plurality of locations.

When the tobacco is distributed in stacks and/or on tobacco pallets within the chamber, and the temperature distribution is not uniform or constant throughout the chamber, this expedient allows the oxygen concentration at particular points to be raised or lowered as may be required for the specific need.

The fermentation can be initiated by the controlled introduction of the oxygen or oxygen-enriched gas directly into the stack, pile or other accumulation of tobacco leaves.

According to the invention, the fermentation is carried out in a closed chamber in which the fermentable tobacco leaves are stored and provided with at least one inlet for an oxygen-rich gas which can be connected to a source of pure oxygen and/or to a source of gas with which oxygen can be mixed to produce the feed gas which should contain oxygen at a concentration of greater than 25%. The chamber is also provided with a discharging duct which is provided with an oxygen-responsive concentration detector connected by a control signal of the servomechanism type which compares a set point value for the oxygen level in the fermentation atmosphere with the actual value determined by the detector and produces an error or difference signal controlling a servomotor valve for regulating the feed of oxygen to or in the supply or feed duct.

According to the invention, therefore, the oxygen concentration in the vented or discharged gases controls the rate at which oxygen is added to the feed gas and hence determines the rate at which the oxygen in the atmosphere is replaced automatically. Obviously this system also provides an automatic control for the nicotine and condensate content of the tobacco product and because a precise oxygen level can be maintained in the fermentation atmosphere, the uniformity of the nicotine and condensate content can be maintained more easily.

It has also been found to be advantageous in this apparatus to broaden the control range by providing parallel gas feed pipes for the oxygen or oxygen-enriched gas at least one of these pipes being provided with a flow meter connected to the control circuitry such that, when the oxygen-containing gas flow through one of the pipes is at a maximum, the oxygen detector controls the servovalve of another pipe. Since the further control system is in parallel with the first-mentioned control system, the latter can serve to establish oxygen supply for the basic demand while the first-mentioned control system can provide fine regulation of the oxygen supply. This has been found to afford a wide range in control of the oxygen supply of the fermentation conditions.

BRIEF DESCRIPTION OF THE DRAWING

The above and other objects, features and advantages of the present invention will become more readily apparent from the following description, reference being made to the accompanying drawing, the sole FIGURE of which is a flow diagram illustrating the principles of the present invention.

SPECIFIC DESCRIPTION AND EXAMPLES

In the drawing we have shown a system for the fermentation and curing of tobacco in leaf form and on pallets in which the atmosphere is air enriched with oxygen so that the oxygen concentration is greater than 50% and is preferably between 60 and 80%, generally about 75%. In the embodiment shown, this atmosphere is made up by injecting pure oxygen, e.g. from a tank, air-rectification plant or the like, into ambient air which is then introduced into the chamber. The relative humidity is held at 55 to 80% and the temperature at 30° to 60° C.

The system can operate with any reasonably sealed tobacco curing chamber so that the atmosphere is controlled exclusively by the gas introduced and the fermentation processes within the chamber. Hence the chamber has been shown only diagrammatically.

More specifically, the tobacco fermentation chamber 1 is provided with pallets 2 of conventional design, each carrying stacks of whole tobacco leaves. A supply line 3 can feed the oxygen/air mixture (or pure oxygen) into the chamber 1 after moisturization in a spray chamber 25, **25*a* or 25*b*. While only a single gas inlet 3*a* need be provided for this purpose, it has been found to be advantageous to provide a multiplicity of such inlets, e.g. the additional inlets 3*b* and 3*c* with their respective humidifying chamber 25*a* and 25*b*, and to control the distribution of the gas to the selected points in the chamber by valves 30*a*, 30*b* and 30*c* which can be controlled by oxygen concentration detectors 31, for example, or by hand. The concentration detectors 31** may be disposed at various locations in the chamber.

The humidifiers 25, **25*a* and 25*b* may, in turn, be controlled by a humidity detector 32** in this chamber as well.

The atmosphere in the chamber changes during fermentation, e.g. by absorption of oxygen and generation of carbon dioxide, the exhaust gas being discharged at 4. A branch 5 from conduit 4 is connected to an oxygen-concentration measuring unit 6 which delivers its actual-value signal to the control circuitry 7 in the form of a comparator which compares the actual value of the oxygen level in the atmosphere with a set point value supplied by the reference signal generator 8. The deviation of the actual value from the set point value is an error or difference signal which is applied to the servomotors 15 and 16.

The principles of such operations are discussed in *Servomechanism Practice,* McGraw-Hill Book Company, New York, 1960, which also discloses the magnetic valves which can be driven by the servomotors 15 and 16.

Thus the valves 13 and 14 which control the supply lines 9 and 10 for air and oxygen, respectively, operate to correct the concentration in the feed line 3 so that more oxygen is supplied when more is consumed and less is supplied when less is consumed, thereby holding the oxygen level in the fermentation chamber substantially constant. Lines 9 and 10 are provided with flow meters 11 and 12 while a branch at line 20 of oxygen from line 10 feeds via a flow meter 23, a line 19 and another magnetic valve 22, into the feed line 2 as well. The humidity control circuitry has been shown in less detail, but it can use exactly the same principles whereby a line equivalent to line 10 delivers water to the feed into line 3 under the control of an electromagnetic valve, a comparator, a set point generator and a moisture detector. The oxygen source 17 can be a tank of compressed or liquefied $O_2$ which is expanded through nozzle 18 to a lower pressure.

While only one additional line 19 has been shown, it is apparent that the range of control can be further increased by additional lines parallel thereto.

In the embodiment shown, should the oxygen level reach a maximum as indicated by the flow meter 12, the controller 24 automatically opens valve 22 to allow the basic oxygen demand to be covered by line 19 and restore fine control to the valve 14 and the comparator 7.

SPECIFIC EXAMPLE

The interior volume of a fermentation chamber for carrying out the present invention is about 120 $m^3$ and 224 tobacco pallets, each of 50 kg of tobacco are stored therein for a fermentation period of 3 to 5 weeks. The relative humidity of the air was held between 55% and 80%, generally above 65% thereby excluding spontaneous ignition of the tobacco in the oxygen-rich atmosphere. Initially the temperature was brought to about 30° C. to start fermentation and the exothermic biological reaction caused the temperature to rise to 60° C.

The gas flow and oxygen introduction were such that the oxygen content added to the selective value was uniform throughout the chamber within a period of 15 to 30 minutes and tests were carried out with desired oxygen levels between 25% and 100% at 5% intervals. In each case the fermentation process was significantly less than the fermentation without oxygen addition, ranging from 5 weeks in the case of 25% oxygen to 3 weeks in the case of close to 100% oxygen.

We claim:

1. A method of fermenting tobacco, comprising the steps of:

storing tobacco in a closed chamber;

maintaining an atmosphere in said chamber which has a concentration of greater than 25% oxygen; and fermenting the tobacco in said chamber endothermically in said atmosphere.

2. A method of fermenting tobacco, comprising the steps of:

storing tobacco in a closed chamber;

maintaining an atmosphere in said chamber which has a concentration of greater than 25% oxygen;

fermenting the tobacco in said chamber endothermically in said atmosphere; and feeding a gas containing oxygen into said chamber to replace oxygen consumed from said atmosphere and discharging an equivalent volume of gas from said chamber.

3. The method defined in claim 2, further comprising the steps of:

measuring the oxygen concentration in the gas discharged from said chamber; and controlling the oxygen introduced into said chamber in response to the measured concentration.

4. The method defined in claim 1, claim 2 or claim 3 wherein an oxygen-rich gas is introduced into said chamber at a plurality of spaced-apart locations.

* * * * *